United States Patent [19]

Gerst

[11] 4,258,764

[45] Mar. 31, 1981

[54] LOG SPLITTING MACHINE

[75] Inventor: Thomas L. Gerst, Twin Lake, Mich.

[73] Assignee: 21st Century Products, Muskegon, Mich.

[21] Appl. No.: 22,681

[22] Filed: Mar. 21, 1979

[51] Int. Cl.[3] ..... B27L 7/00

[52] U.S. Cl. ..... 144/193 R; 74/34; 192/93 B

[58] Field of Search ..... 74/30, 34, 31; 192/93 B; 254/95; 144/193 R

[56] References Cited

U.S. PATENT DOCUMENTS

| | | | |
|---|---|---|---|
| 470,104 | 3/1892 | Dante | 144/193 |
| 946,705 | 1/1910 | Power | 144/193 R |
| 1,231,525 | 6/1917 | Hauberg | 144/193 |
| 1,310,660 | 7/1919 | Inman | 144/193 |
| 1,358,556 | 11/1920 | Johnson | 144/193 R |
| 1,457,966 | 6/1923 | Eastman | 144/193 R |
| 1,666,795 | 4/1928 | Schmidt | 144/193 |
| 2,446,585 | 8/1948 | Hanners | 144/193 |
| 2,493,914 | 1/1950 | Corey et al. | 144/193 |
| 3,988,936 | 11/1976 | Comly, Jr. | 74/34 |
| 4,116,251 | 9/1978 | Graney | 144/193 R |

*Primary Examiner*—W. Donald Bray

*Attorney, Agent, or Firm*—Price, Heneveld, Huizenga & Cooper

[57] ABSTRACT

The specification discloses a wood splitter in which the ram for driving a piece of wood into a cutter can be selectively engaged or disengaged with a motor driven flywheel. The drive train between the motor and flywheel includes a clutch means which effectively disengages the motor if the load on the flywheel becomes too great, thereby preventing motor overload. The rack and pinion driven ram is mounted on an elongated beam which includes a trailer hitch at one end and which is supported on wheels at the other end whereby the entire splitter is portable.

37 Claims, 7 Drawing Figures

LOG SPLITTING MACHINE

BACKGROUND OF THE INVENTION

The present invention relates to wood splitters. An emerging energy consciousness has rendered such devices more popular. Splitters in which a ram for driving the wood into a cutter is driven by a hydraulic or air cylinder are commonly available on the market.

The drawback with such splitters is that they are somewhat slow and generally expensive. The prior art is repleat with various mechanical splitters, but none of them seem to be available in the market place. While the reasons for commercial failure of these mechanical devices are not known for certain, some of the drawbacks of such constructions can be appreciated by studying them.

For example the device disclosed in the patent to Power U.S. Pat. No. 946,705 discloses a crank driven ram to which an axe head is connected. The crank can be engaged with a pulley which is driven by a motor. However, this places a heavy load on the motor, particularly when the crank is first engaged.

The patents to Hauberg U.S. Pat. No. 1,231,525 and Schmidt U.S. Pat. No. 1,666,795 both disclose devices which operate continually. Continual operation may help to minimize overload problems, but such continual operation is of course dangerous. One would have to be very careful to avoid getting his hands and arms cut while trying to feed wood to a continually operating machine.

The relatively high cost and slow operation of air and hydraulic cylinder wood splitters and the past failure of mechanical alternatives illustrates the long felt need in this art for an effective mechanical splitter.

SUMMARY OF THE INVENTION

In the present invention, the ram of a wood splitter can be selectively engaged or disengaged with a motor driven flywheel to drive the wood against a cutter or to drive a cutter against the wood. The drive train between the motor and flywheel includes clutch means which effectively disengages the motor if the load on the flywheel becomes too great, thereby preventing motor overload.

The splitter employs a unique rack and pinion driven ram mounted on a beam which in turn is fitted with wheels and a hitch so that the entire device is portable.

These and other objects, advantages and features of the invention will be more fully understood and appreciated by reference to the written specification and appended drawings.

DESCRIPTION OF THE PREFERRED EMBODIMENT

Figure 1:
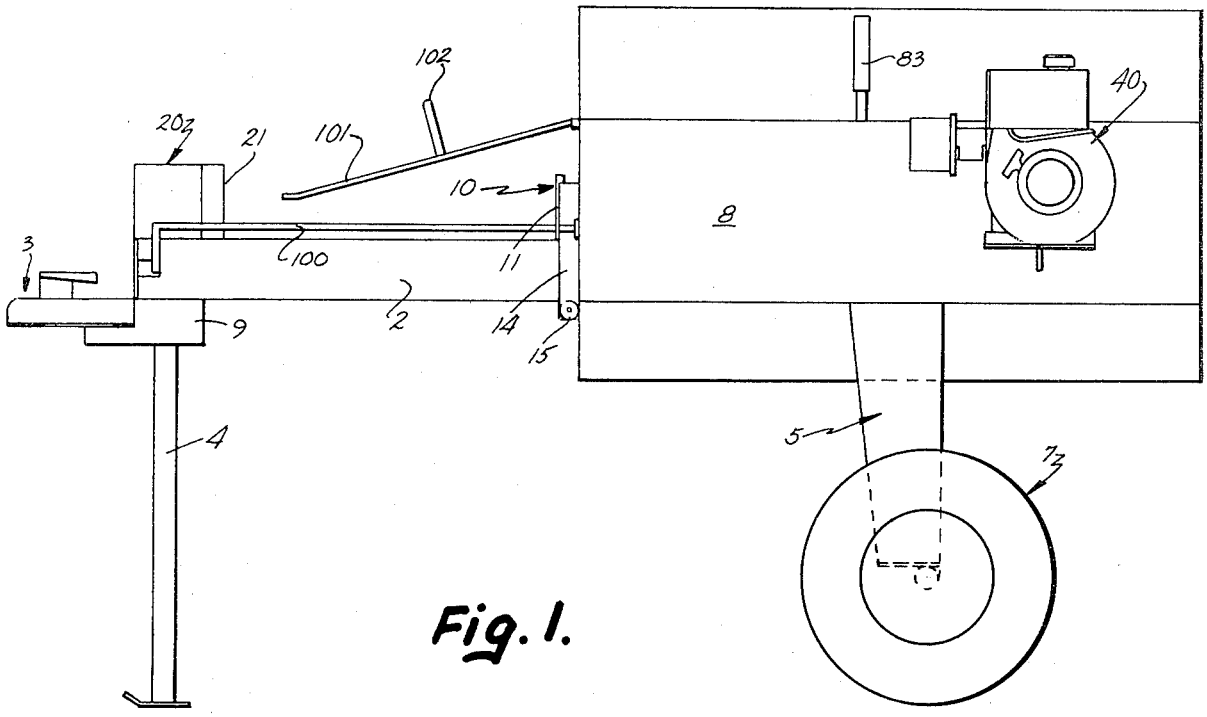
FIG. 1 is a side elevational view of a wood splitter made in accordance with the present invention.

In the preferred embodiment, the wood splitter 1 (FIGS. 1–3) of the present invention comprises a ram 10 slidably mounted on an elongated beam 2 for ramming a piece of wood against a cutter 20. Ram 10 can be selectively engaged or disengaged from flywheel 30 which is driven by a motor 40. The drive train 50 includes a pivotally mounted weighted idler wheel 60 which serves as a clutch to effectively disengage motor 40 in the event that the load imposed upon flywheel 30 becomes too great.

Elongated beam 2 is a hollow steel beam which includes a hitch assembly 3 at the front end thereof (FIG. 1) and a leg 5 secured thereto towards the rear and extending downwardly therefrom and being joined to an axle assembly 6 for a pair of spaced wheels 7 such that the entire splitter is trailerable (FIGS. 1–3 and 7). Also secured to the front of beam 2 on the underside thereof is a bracket 9 which facilitates connection of hitch 3 to beam 2 and which also serves as a pivot mounting for a front stand 4. Stand 4 can be pivoted to an up position located generally parallel to and just beneath beam 2 and the interconnection between bracket 9 and standard 4 is such that standard 4 can be locked in said up position.

Figure 7:
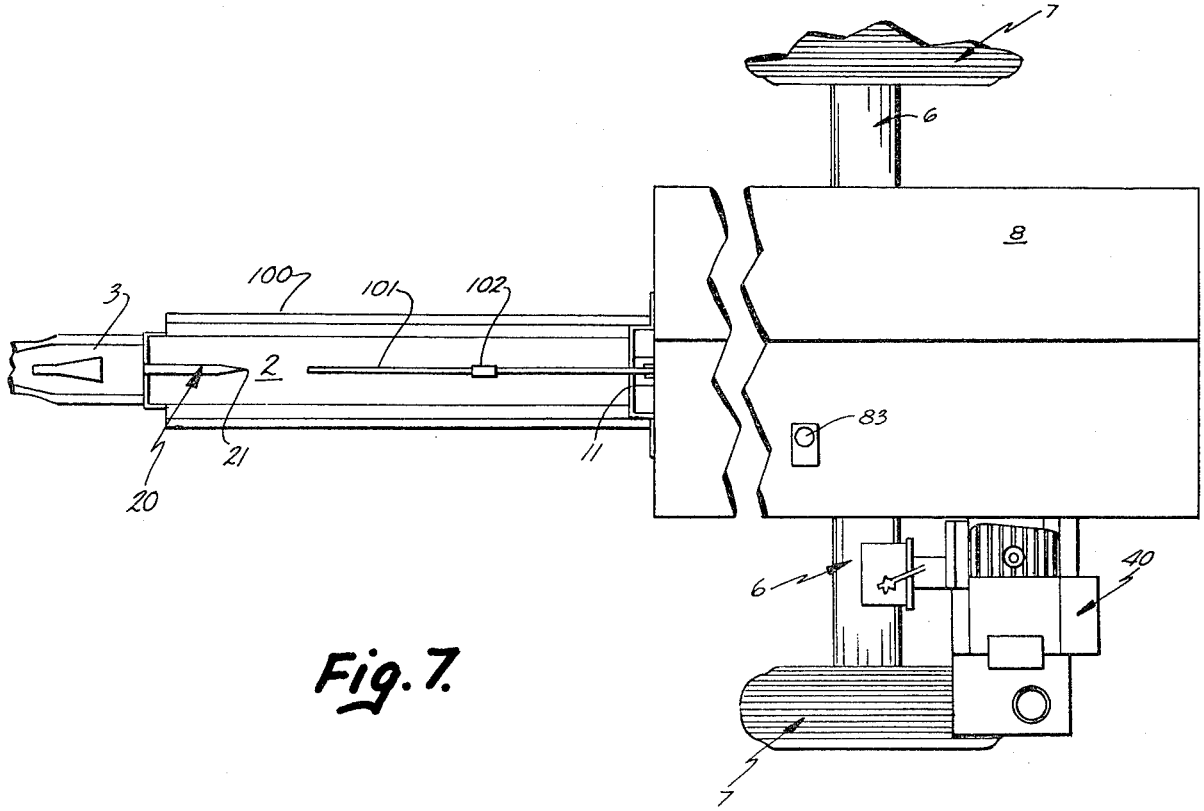
FIG. 7 is a top plan view of the splitter.

Most of the mechanism of splitter 1 is normally covered by a metal housing 8 (FIGS. 1 and 7). However, housing 8 has been shown removed, as has motor 40, in FIGS. 2 and 3 so that the internal workings of splitter 1 can be more fully understood and appreciated.

Ram 10 includes a head 11 which is a steel plate welded to the end of ram 10. Ram 10 itself is a steel bar with a rack 12 formed throughout most of its length from the rear end thereof approximately three quarters of the way towards the front. Ram 10 slides in a guide 13 which is formed by small metal plates welded to beam 2 on either side of ram 10. Ram 10 is also guided as it slides along beam 2 by means of a carriage assembly defined by a pair of carriage legs 14 which extend downwardly from head 11 on either side of beam 2 and by a carriage roller 15 extending therebetween beneath beam 2.

Figure 2:
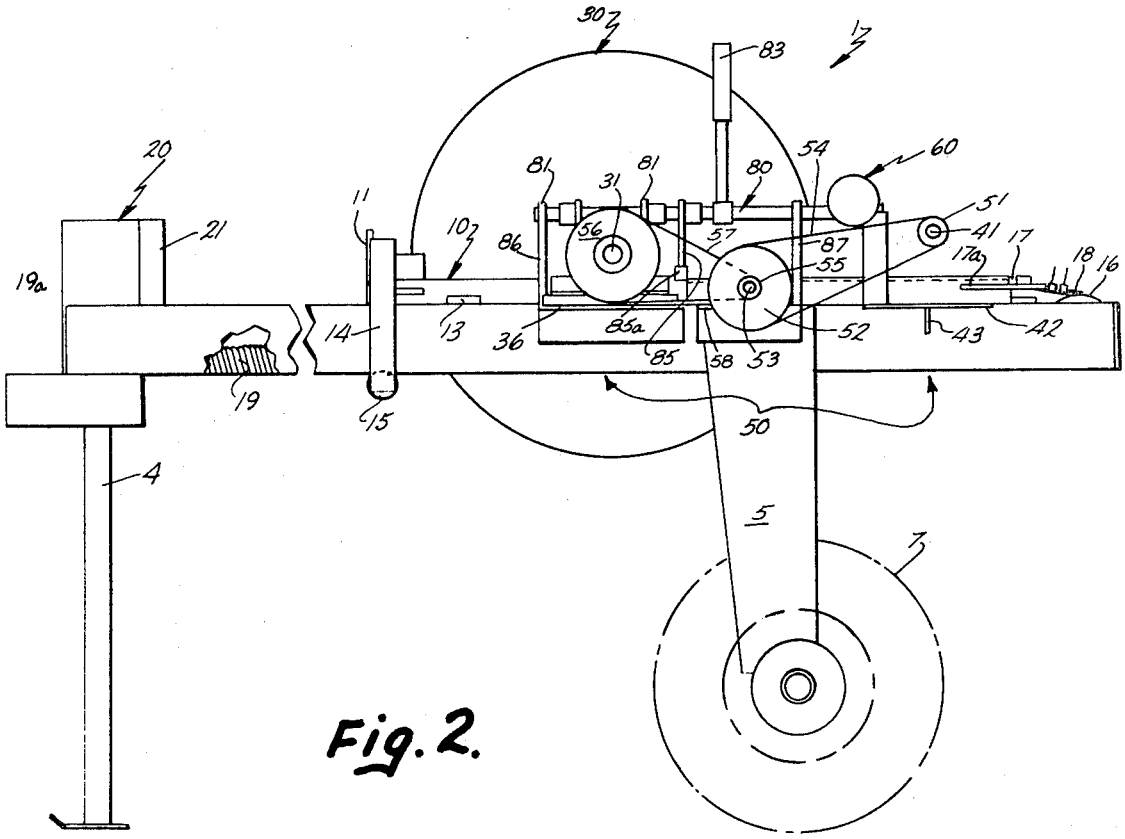
FIG. 2 is a fragmentary side elevational view with the motor, cover and wood holding frame removed.

Welded to the rear of ram 10 is a kickout plate 17 which has a sloped leading edge **17*a*. Also welded thereto is a bracket 18*a* to which is secured a cable 18 which extends rearwardly from ram 10. Cable 18 extends over a pulley 16 which is rotatably mounted within the hollow interior of beam 2. Cable 16 then runs forwardly for distance approximately as long as ram 10. Its end is joined to a very heavy spring 19, which is comperable to a garage door spring, which is located within the hollow interior of beam 2 and which is joined to the front end of beam 2 by means of an eyebolt assembly 19*a* (FIG. 2). The tension in spring 19 can be adjusted by tightening or loosening the nut in eyebolt assembly 19*a*. The assembly of cable 18 and spring 19 and their related components serve as a return for ram 10** and pull it rearwardly to its starting position after it has completed a forward log splitting stroke.

Cutter 20 is a relatively thin hardened steel blade with a sharp leading edge 21. It is welded to the front of beam 2 so that it projects upwardly therefrom in line with the path which the head 11 of ram 10 follows. Head 11 will stop short of engagement with splitter 20, but the stroke of ram 10 is sufficiently great that a piece of wood placed on beam 2 will be split in two as it is driven over and past cutter 20.

Flywheel 30 comprises any heavy wheel. It has been found that a conventional automobile or trailer tire 33 mounted on a rim 34 is operable as flywheel 30. Flywheel 30 is mounted in a conventional manner on an axle 31. Axle 31 is in turn carried in conventional bearing assemblies 35 generally at either end thereof which in turn are mounted on steel plate platforms 36 which are welded to and which project laterally from either side of beam 2. Thus, axle 31 extends across beam 2 and across and above ram 10.

Figure 3:
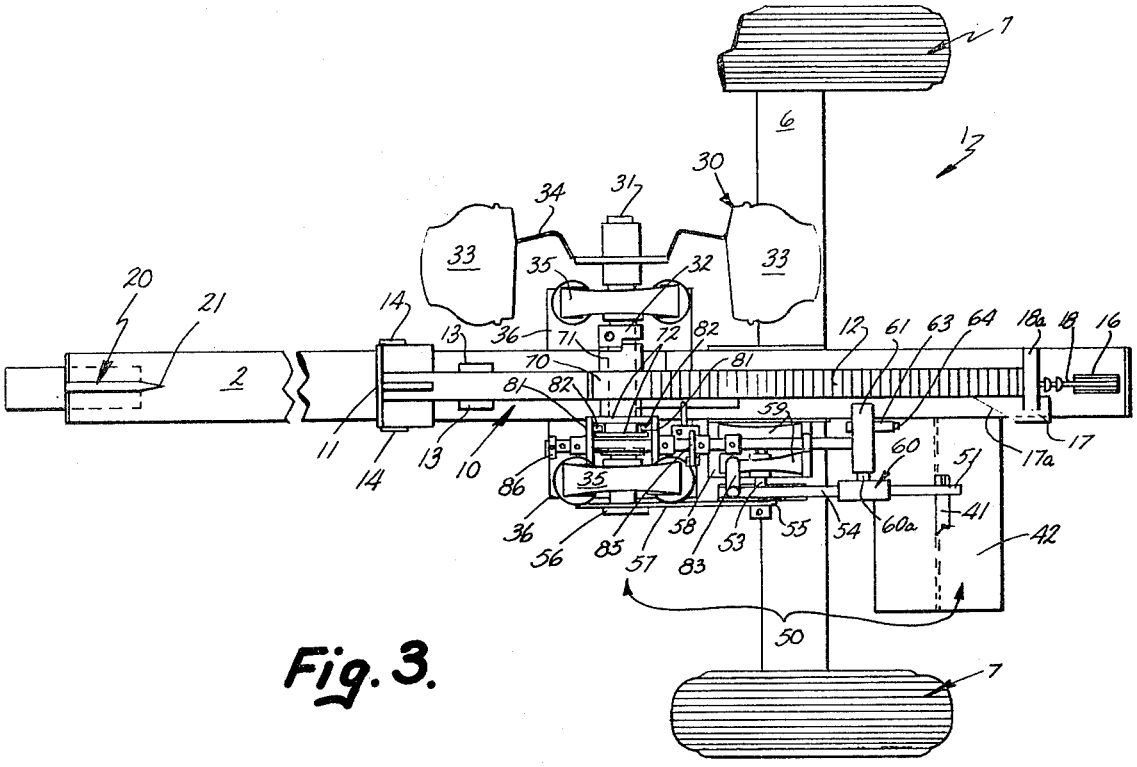
FIG. 3 is top plan view of the splitter with the motor, cover and wood holder frame removed.
Figure 5:
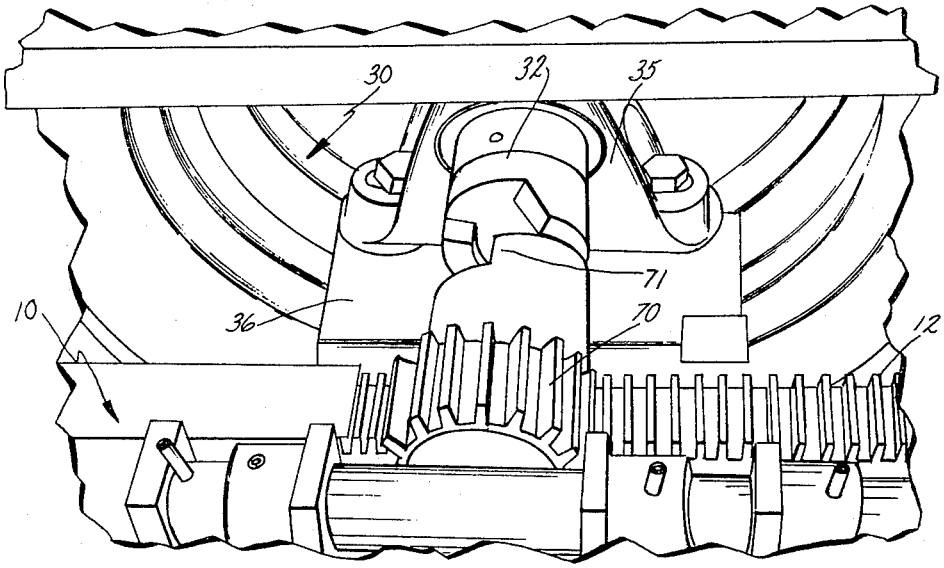
FIG. 5 is an elevated perspective view of the clutch for engaging and disengaging with the flywheel.

Flywheel 30 is fixedly joined to axle 31 so that it rotates with it. Also fixedly secured to axle 31 at a point on the inside of the bearing 35 which is closest to flywheel 31 is a clutch cog 32 (FIGS. 3 and 5). Clutch cog 32 forms one half of the clutch assembly which selectively engages or disengages ram 10 with flywheel 30.

Motor 40 is a conventional four cycle engine of approximately four horse power. A gasoline engine of the type manufactured by the type "Tecumseh" or by others is satisfactory for purposes of the present invention (FIGS. 1 and 7). Motor 40 is mounted on metal platform 42 which includes another metal brace 43 welded therebeneath. Both platform 42 and brace 43 are welded to the side of beam 2.

The drive train 50 between motor 40 and flywheel 30 can best be seen by reference to FIGS. 2 and 3. It comprises first a minor pulley 51 mounted on the motor drive shaft 41. It in turn drives a major pulley 52 by means of drive belt 54. Major pulley 52 is mounted on an axle 53 which is also common to a minor sprocket 55. A metal platform 58 is welded to the side of beam 2 and projects laterally therefrom. Major pulley axle 53 is rotatably carried in spaced bearings 59 which are mounted on platform 58. Minor sprocket 55 drives a major sprocket 56 by means of a chain 57 extending therebetween. Major sprocket 56 is fixedly mounted on one end of axle 31 whereby motor 40 drives flywheel 30 through drive train 50.

Figure 6:
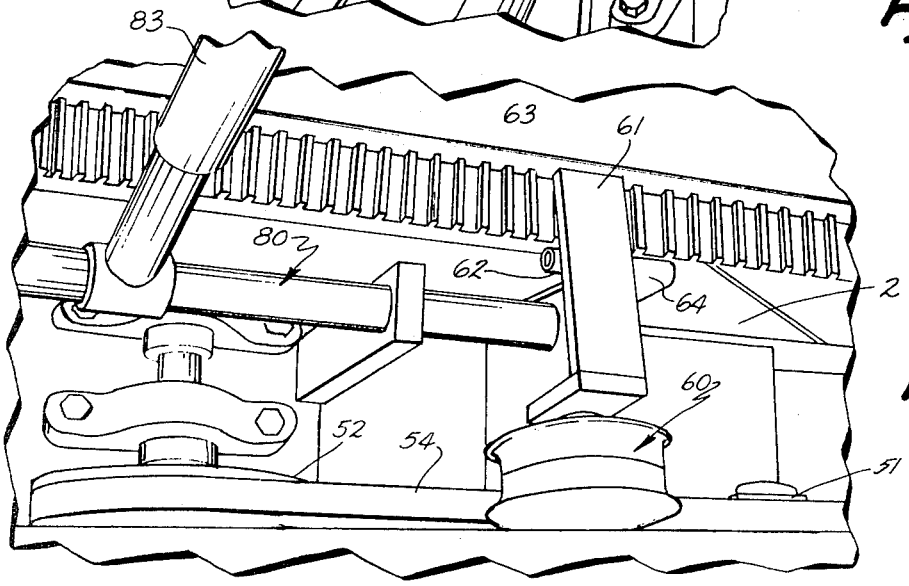
FIG. 6 is an elevated perspective view of the weighted idler which acts as an overload clutch to prevent the motor from being overloaded.

Weighted idler wheel 60 rests against the top of drive belt 54. It is rotably mounted on a small axle 60*a* which is carried on a generally L-shaped bracket 61 (FIGS. 3 and 6). The rearwardly extending leg of L-shaped bracket 61 is in turn welded to a sleeve 62 which is pivotally joined to a small axle 63 which in turn is welded to bracket 64 which is welded to beam 2.

The weight of idler wheel 60, including to some extent the weight of generally L-shaped leg 61 causes idler wheel 60 to bear down on belt 64 just sufficiently to enable motor 40 to rotate flywheel 30 through drive train 50. When there is no load on flywheel 30, there is very little slippage on belt 54 and motor 40 brings flywheel 30 up to speed relatively quickly. In the event of an overload, however, idler wheel 60 is sufficiently light that minor drive pulley 51 readily slides with respect to belt 54 thereby preventing motor 40 from being overloaded.

Figure 4:
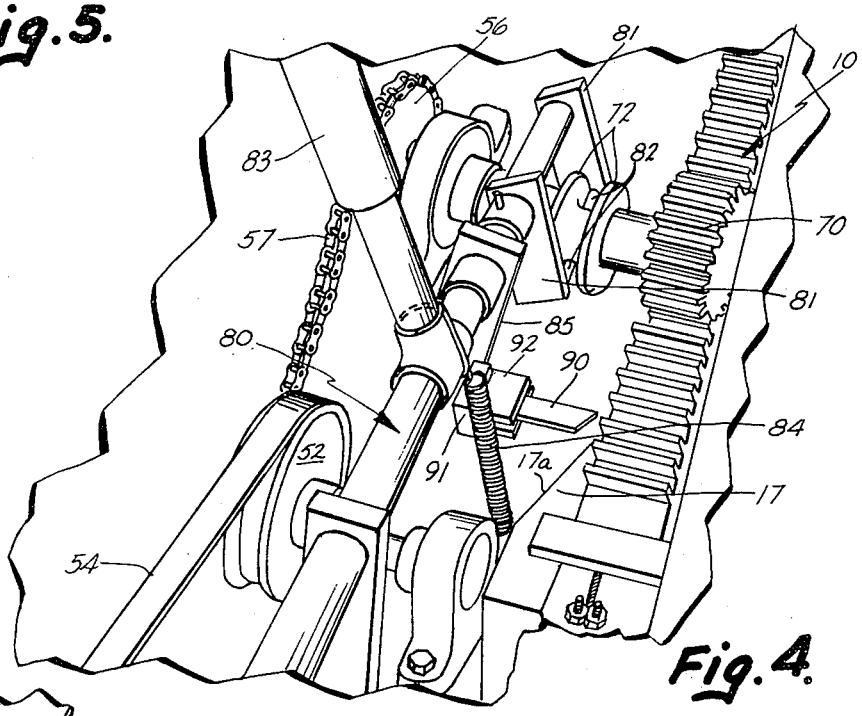
FIG. 4 is a slightly elevated perspective view of the mechanism for activating the ram.

The clutch and drive linkage between flywheel 30 and ram 10 comprises first a pinion 70 which is rotatably and slidably carried on fly wheel axle 31 (FIGS. 3, 4 and 5). Pinion 70 can be shifted from left to right on axle 31. However, if preferably is always in engagement with rack 12 of ram 10. Welded to one side of pinion 70 is a clutch cog 71 which is designed for clutching engagement with clutch cog 32. Thus when pinion 70 and clutch cog 71 are shifted towards clutch cog 32, clutch cog 71 and 32 engage, thereby causing pinion 70 to rotate with flywheel 30, which in turn drives rack 12 and ram 10 forwardly.

The control mechanism for shifting pinion 70 and clutch cog 71 begins with a pair of radial pinion guide plates 72 which are also fixedly secured to pinion 70 on the side opposite cog 71 and which are spaced from one another slightly (FIG. 4). Pinion guide plates 72 rotate and shift with pinion 70 and clutch cog 71.

Plates 72, pinion 70 and clutch cog 71 are shifted by means of pinion guide levers 81 which project downwardly to either side of guide plates 72 and which include cam roller bearings 82 projecting inwardly towards one another and into the space between guide plates 72. Pinion guide levers 81 are in turn fixedly mounted on a control shaft 80 which extends above and generally parallel to beam 2 (FIGS. 2 and 4). Control shaft 80 is pivotally mounted at one end in a front standard 86 and at the other end in a rear standard 87. Front standard 86 is welded to one of the projecting platforms 36 (i.e. that on the side of beam 2 which is opposite flywheel 30). Rear standard 87 is welded to and projects upwardly from platform 58 which serves as the mounting platform for major pulley axal 53 of drive train 50.

Also fixedly secured to and projecting upwardly from control shaft 80 is a handle lever 83. By pulling handle lever 83 to one side, one rotates control shaft 80 and thereby pivots guide levers 81. This in turn causes guide plates 72 to shift towards clutch cog 32, which shifts clutch cog 71 into engagement with clutch cog 72. A return spring 84 is secured at one end to handle lever 83 and at the other end to platform 58 so as to pull handle 83 back to its original position when pressure from handle 83 is released, thereby shifting clutch cog 71 out of engagement with clutch cog 32.

Also fixedly secured to control shaft 80 is a downwardly projecting kick out lever 85 (FIGS. 2 and 4). It includes an enlargement 85*a* on the bottom end thereof (FIG. 2). The enlarged end 85*a* of kick out lever 85 is in alignment with a kick out plunger 90 mounted in a mounting bracket 92 which is secured to platform 36 on the side of beam 2 away from flywheel 30 (FIG. 4). The tip of kick out plunger 90 is in alignment with the leading edge 17*a* of kick out plate 17 on the rear of ram 10. Thus as the sloped leading edge of kick out plate 17 engages the tip of plunger 90 (FIG. 4), plunger 90 is gradually pushed away from ram 10 and the head 91 of plunger 90 in turn engages the enlarged end 85*a* of kick out lever 85 so as to push lever 85 laterally away from ram 10. This pivots control rod 80 which in turn pivots guide levers 81, which in turn shifts guide plates 72, pinion 70 and clutch cog 71 away from clutch cog 72, thereby causing the clutch cogs to disengage and allowing ram 10 to be returned by the action of spring 19. Thus in spite of an operator holding lever 83 over, the system automatically disengages at the end of the stroke of ram 10 by means of the interaction kick out plate 17, kick out plunger 90 and kick out lever 85.

A pair of wood guide rails 100 are mounted on either side of beam 2 and project just slightly above the level of beam 2 (FIGS. 1 and 7). These help hold a piece of wood in place on beam 2 between the head 11 or ram 10 and the cutting edge 21 of cutter 20. To help prevent a piece of wood from riding up over cutter 20, a wood hold down arm 101 is pivotally mounted to housing 8 at one end so that its free end pivots up and down over beam 2. A handle 102 projects upwardly from hold down 101. By placing a piece of wood under hold down arm 101 and applying pressure with one hand against handle 102, one can minimize the chances of a piece of wood riding up as it is forced against cutter 20. Further, safety can be facilitated by securing a shroud to hold down arm 101 such that the piece of wood and the cutter 20 are shrouded during the actual splitting operation.

In operation, the user starts the motor 40 which in turn rotates flywheel 30 through drive train 50. The user grasps handle 102 and lifts hold down arm 101. He then places a small log or piece of wood on beam 2 between the wood guide rails 100. He then pulls handle 83 towards him. This pivots control shaft 80 which in turn pivots guide levers 81 which in turn shift guide plates 72, pinion 70 and clutch cog 71 towards clutch cog 32. Clutch cog 71 is thus forced into engagement with clutch cog 32 and the rotation of flywheel 30 causes rotation of pinion 70. Rotation of pinion 70 in turn drives rack 12 and ram 10 forwardly so as to push the block of wood into and past cutter 20, thereby splitting it.

When ram 10 first begins to push a block of wood against cutter 20, a heavy surge load is placed on the system which is absorbed by the inertia of flywheel 30. However, if the load is too great, it might stall motor 40 and cause damage, but for the action of pivotally mounted idler 60 which is sufficiently light that minor pulley wheel 51 on motor output shaft 41 slips with respect to belt 54, thereby preventing an overload in spite of the loads imposed on flywheel 30.

As ram 10 nears the end of its stroke, the leading sloped edge 17*a* of kick out plate 17 engages the tip of kick out plunger 91 and drives it laterally away from ram 10. It in turn pushes kick out lever 85 over, which pivots control shaft 80 and guide levers 81. This pivoting action pulls guide plates 72, pinion 70 and cog 71 away from clutch cog 32, thereby causing clutch cog 71 and 32 to disengage. Upon such disengagement, return spring 19 pulls on cable 18 and pulls ram 10 back to its original position. Pinion 70 is simply rotated in reverse as ram 10 returns.

The entire splitter 1 is highly portable. Front stand 4 can be rotated in an up position and hitch 3 can be secured to a trailer hitch on a vehicle. Splitter 1 then trails along behind the vehicle. Of course, it is understood that the above is merely a preferred embodiment of the invention and that various changes and alterations can be made without departing from the spirit and broader aspects thereof as set forth in the appended claims which are to be interpretted in accordance with the scope and content of the prior art and the doctrine of equivalents.

The embodiments of the invention in which an exclusive property or privelege is claimed are defined as follows:

1. A wood splitter including one of a head and cutter mounted on a ram and the other fixedly positioned in opposition thereto and in the path thereof whereby a piece of wood placed therebetween will be split upon movement of said ram, the improvement in said wood splitter comprising: an energy storing flywheel; a motor for driving said flywheel; drive train means connecting said motor and said flywheel whereby said flywheel is driven by said motor; ram drive means for driving said ram forwardly; first clutch means operably mounted between said flywheel and said ram drive means for selectively engaging and disengaging same whereby said ram is driven forwardly by said flywheel when said ram drive means and said flywheel are engaged; second clutch means in said drive train means for effectively disengaging said motor from said drive means and said flywheel when loads on said flywheel would otherwise cause undue loading on said motor.

2. The splitter of claim 1 wherein said drive train includes a belt passing over two pulleys; said second clutch means comprising an idler wheel rotatably mounted on the end of a pivotally mounted arm, said idler wheel resting on and engaging said belt through gravity, said idler wheel and said arm being of sufficient weight that said gravity engagement is sufficient to enable said motor to drive said flywheel through said pulleys and said belt, but wherein said idler wheel and said arm are sufficiently light that when an undue force is exerted on said flywheel, said idler wheel will tend to pivot upwardly and allow said motor to rotate freely while said belt slides relative to that one of said pulleys which is operably connected to said motor.

3. The splitter of claim 1 or 2 in which said ram includes a gear rack; said ram drive means comprising a pinion gear engaging said rack.

4. The splitter of claim 3 in which said flywheel is fixedly secured to an axle extending therefrom over and above said rack; said drive train being operably connected to said axle for rotating same and for thereby rotating said flywheel; said pinion gear being rotatably and slidably carried on said axle at a point generally above said rack; said first clutch means comprising spaced clutch cogs, one being fixedly secured to said axle and the other being fixedly secured to said pinion gear; lever means being operably connected to said pinion gear and its attached cog for sliding said pinion gear and its attached cog on said axle towards said cog which is fixedly secured to said axle, whereby said spaced cogs become engaged, thereby causing said pinion gear to rotate with said flywheel and drive said rack and said ram forwardly.

5. The splitter of claim 4 wherein said lever means are fixedly secured to a control shaft, said control shaft being mounted above said axle and generally parallel to said ram; said lever means extending downwardly from said control shaft and including at least one bearing projecting laterally therefrom into the space between two spaced guide plates, said spaced guide plates being interconnected to each other and to said pinion gear and being slidably and rotatably carried on said flywheel axle; a handle being fixedly secured to and projecting upwardly from said control shaft whereby when one pulls on said handle, one rotates said control shaft and said lever means and thereby shifts said guide plates, said pinion gear and said attached clutch cog towards said flywheel clutch cog.

6. The splitter of claim 5 in which bias means are operably connected to said handle for biasing said handle, said control shaft and said lever means into a position wherein said first clutch means are disengaged.

7. The splitter of claim 6 wherein said lever means comprise a pair of spaced levers projecting downwardly to either side edge of said spaced guide plates, each of said levers including one of said bearings projecting inwardly into the space between said spaced guide plates.

8. The splitter of claim 5 which includes kick out means operably connected to said first clutch means for automatically disengaging said first clutch means at the end of the splitting stroke of said ram.

9. The splitter of claim 8 wherein said kick out means comprises a kick out plate secured to the end of said ram and including a sloped leading edge; said kick out means further including a plunger slidably mounted adjacent said ram and extending generally laterally therefrom; said kick out means further including a kick out lever fixedly secured to said control shaft with one end positioned generally in alignment with the end of said plunger; the opposite end of said plunger being positioned generally in alignment with the path of the sloped leading edge of said kick out plate whereby as said ram nears the end of its stroke, said sloped leading edge of said kick out plate engages the end of said plunger forcing it laterally away from said ram, thereby shifting said kick out lever and rotating said control shaft, which in turn pivots said lever, which in turn shifts said guide plates, said pinion gear and said associated clutch cog away from said flywheel clutch cog.

10. The splitter of claim 9 wherein bias means are operably connected to said ram for biasing said ram towards an at rest position with said head and said cutter spaced a sufficient distance apart that one can insert a piece of wood therebetween.

11. The splitter of claim 10 wherein said clutch cog of said first clutch means is formed of hardened steel.

12. The splitter of claim 1 which includes kick out means operably connected to said first clutch means for automatically disengaging said first clutch means at the end of the splitting stroke of said ram.

13. The splitter of claim 1 wherein said first clutch means comprise spaced, hardened steel clutch cogs.

14. The splitter of claim 1 wherein bias means are operably connected to said ram for biasing said ram towards an at rest position with said head and said cutter spaced a sufficient distance apart that one can insert a piece of wood therebetween.

15. The splitter of claim 1 or 8 which includes wheels operably connected to said beam and a trailer hitch projecting forwardly from the front of said beam whereby said splitter can be trailered behind a vehicle.

16. The splitter of claim 15 wherein a hold down lever is pivotally mounted above said beam between said head and said cutter, said lever including handle means whereby one can force said lever down onto a piece of wood located on said beam between said cutter and said head.

17. A wood splitter including a ram with one of a head and cutter mounted thereon and with the other fixedly positioned in opposition thereto and in the path thereof whereby a piece of wood placed therebetween will be split upon movement of said ram, the improvement in said wood splitter comprising: an energy storing flywheel; a motor for driving said flywheel; a gear rack on said ram; a pinion gear engaging said rack for driving said ram forwardly; first clutch means operably mounted between said fly wheel and said pinion gear for selectively engaging and disengaging same whereby said ram is driven forwardly when said flywheel and pinion gear are engaged and whereby said ram can be returned to an at rest position when said flywheel and pinion gears are disengaged.

18. The splitter of claim 17 in which said flywheel is fixedly secured to an axle extending therefrom over and above said rack; a drive train being operably connected to said motor and to said axle for rotating same and for thereby rotating said flywheel; said pinion gear being rotatably and slidably carried on said axle at a point generally above said rack; said first clutch means comprising spaced clutch cogs, one being fixedly secured to said axle and the other being fixedly secured to said pinion gear; lever means being operably connected to said pinion gear and its attached cog for sliding said pinion gear and its attached cog on said axle towards said cog which is fixedly secured to said axle, whereby said spaced cogs become engaged, thereby causing said pinion gear to rotate with said flywheel and drive said rack and said ram forwardly.

19. The splitter of claim 18 wherein said lever means are fixedly secured to a control shaft, said control shaft being mounted above said axle and generally parallel to said ram; said lever means extending downwardly from said control shaft and including at least one bearing projecting laterally therefrom into the space between two spaced guide plates, said spaced guide plates being interconnected to each other and to said pinion gear and being slidably and rotatably carried on said flywheel axle; a handle being fixedly secured to and projecting upwardly from said control shaft whereby when one pulls on said handle, one rotates said control shaft and said lever means and thereby shifts said guide plates, said pinion gears and said attached clutch cog towards said flywheel clutch cog.

20. The splitter of claim 19 in which bias means are operably connected to said handle for biasing said handle, said control shaft and said lever means into a position wherein said first clutch means are disengaged.

21. The splitter of claim 20 wherein said lever means comprise a pair of spaced levers projecting downwardly to either side edge of said spaced guide plates, each of said levers including one of said bearings projecting inwardly into the space between said spaced guide plates.

22. The splitter of claim 17 or 19 which includes kick out means operably connected to said first clutch means for automatically disengaging said first clutch means at the end of the splitting stroke of said ram.

23. The splitter of claim 22 wherein said kick out means comprises a kick out plate secured to the end of said ram and including a sloped leading edge; said kick out means further including a plunger slidably mounted adjacent said ram and extending generally laterally therefrom; said kick out means further including a kick out lever fixedly secured to said control shaft with one end positioned generally in alignment with the end of said plunger; the opposite end of said plunger being positioned generally in alignment with the path of the sloped leading edge of said kick out plate whereby as said ram nears the end of its stroke, said sloped leading edge of said kick out plate engages the end of said plunger forcing it laterally away from said ram, thereby shifting said kick out lever and rotating said control shaft, which in turn pivots said lever, which in turn shifts said guide plates, said pinion gear and said associated clutch cog away from said flywheel clutch cog.

24. The splitter of claim 23 wherein bias means are operably connected to said ram for biasing said ram towards an at rest position with said head and said cutter spaced a sufficient distance apart that one can insert a piece of wood therebetween.

25. The splitter of claim 24 wherein said clutch cogs of said first clutch means comprise hardened steel.

26. The splitter of claim 17 or 19 which includes wheels operably connected to said beam and a trailer hitch projecting forwardly from the front of said beam whereby said splitter can be trailered behind a vehicle.

27. The splitter of claim 16 or 26 wherein a hold down lever is pivotally mounted above said beam between said head and said cutter, said lever including handle means whereby one can force said lever down onto a piece of wood located on said beam between said cutter and said head.

28. A wood splitter including one of a head and cutter mounted thereon and the other fixedly positioned in opposition thereto and in the path thereof whereby a piece of wood placed therebetween will be split upon movement of said ram, the improvement in said wood splitter comprising: a beam extending the length of said wood splitter; said ram being slidably carried on said beam and including a gear rack thereon; said other of said head and said cutter being mounted on said beam near the end thereof; an axle operably and rotatably mounted on said beam and above said beam and said gear rack; a flywheel fixedly mounted on the end of said axle; a pinion gear being slidably and rotatable mounted on said axle in engagement with said rack; guide plates being operably connected to said pinion and being slidably and rotatable carried on said axle; a flywheel clutch cog being operably secured to said flywheel for rotation therewith and a pinion clutch cog being operably secured to said pinion gear for rotation therewith in juxtaposition with said flywheel clutch cog; a pair of spaced guide plates joined to each other and operably connected to said pinion gear for rotation therewith and being slidably and rotatably carried on said axle; a control shaft operably mounted on said beam, generally parallel thereto; a lever fixedly secured to said control shaft and extending downwardly therefrom; a bearing extending from said lever to and between said guide plates; a handle fixedly secured to and projecting from said control shaft for rotating said control shaft whereby said lever is rotated, thereby shifting said guide plates, said pinion gear and said pinion clutch cog towards said flywheel cog, thereby causing said pinion clutch cog and said flywheel clutch cog to engage and thereby causing said pinion gear to rotate with said flywheel and drive said ram forwardly.

29. The splitter of claim 28 in which bias means are operably connected to said handle for biasing said handle, said control shaft and said lever means into a position wherein said first clutch means are disengaged.

30. The splitter of claim 29 wherein said lever means comprise a pair of spaced levers projecting downwardly to either side edge of said spaced guide plates, each of said levers including one of said bearings projecting inwardly into the space between said guide plates.

31. The splitter of claim 28 which includes kick out means operably connected to said first clutch means or automatically disengaging said first clutch means at the end of the splitting stroke of said ram.

32. The splitter of claim 31 wherein said kick out means comprises a kick out plate secured to the end of said ram and including a sloped leading edge; said kick out means further including a plunger slidably mounted adjacent said ram and extending generally laterally therefrom; said kick out means further including a kick out lever fixedly secured to said control shaft with one end positioned generally in alignment with the end of said plunger; the opposite end of said plunger being positioned generally in alignment with the path of the sloped leading edge of said kick out plate whereby as said ram nears the end of its stroke, said sloped leading edge of said kick out plate engages the end of said plunger forcing it laterally away from said ram, thereby shifting said kick out lever and rotating said control shaft, which in turn pivots said lever, which in turn shift said guide plates, said pinion gear and said associated clutch cog away from said flywheel clutch cog.

33. The splitter of claim 28 or claim 32 wherein bias means are operably connected to said ram for biasing said ram towards an at rest position with said head and said cutter spaced a sufficient distance apart that one can insert a piece of wood therebetween.

34. The splitter of claim 33 which includes wheels operably connected to said beam and a trailer hitch projecting forwardly from the front of said beam whereby said splitter can be trailered behind a vehicle.

35. The splitter of claim 28 or 32 which includes wheels operably connected to said beam and a trailer hitch projecting forwardly from the front of said beam whereby said splitter can be trailered behind a vehicle.

36. The splitter of claim 35 wherein a hold down lever is pivotally mounted above said beam between said head and said cutter, said lever including handle means whereby one can force said lever down onto a piece of wood located on said beam between said cutter and said head.

37. The splitter of claim 28 or 32 wherein a hold down lever is pivotally mounted above said beam between said head and said cutter, said lever including handle means whereby one can force said lever down onto a piece of wood located on said beam between said cutter and said head.

* * * * *

UNITED STATES PATENT AND TRADEMARK OFFICE

CERTIFICATE OF CORRECTION

PATENT NO. : 4,258,764

DATED : March 31, 1981

INVENTOR(S) : Thomas L. Gerst

It is certified that error appears in the above—identified patent and that said Letters Patent is hereby corrected as shown below:

Column 2, line 54:

"comperable" should be --comparable--

Column 3, line 62:

"fly wheel" should be --flywheel--

Column 3, line 64:

"if" should be --it--

Column 4, line 24:

"axal" should be --axle--

Column 4, line 62:

"or" should be --of--

Column 5, line 50:

"interpretted" should be --interpreted--

Column 5, line 54:

"privelege" should be --privilege--

Column 6, line 3:

insert --train-- between "drive" and "means"

UNITED STATES PATENT AND TRADEMARK OFFICE

CERTIFICATE OF CORRECTION

PATENT NO. : 4,258,764

DATED : March 31, 1981

INVENTOR(S) : Thomas L. Gerst

It is certified that error appears in the above—identified patent and that said Letters Patent is hereby corrected as shown below:

Column 9, line 19:

"rotatable" should be --rotatably--

Column 9, line 22:

"rotatable" should be --rotatably--

Column 10, line 1:

insert --spaced-- between "said" and "guide"

Signed and Sealed this

*Eleventh* Day of *August 1981*

[SEAL]

*Attest:*

GERALD J. MOSSINGHOFF

*Attesting Officer*

*Commissioner of Patents and Trademarks*